US007571510B2

(12) United States Patent
Yamada

(10) Patent No.: US 7,571,510 B2
(45) Date of Patent: Aug. 11, 2009

(54) CLEANER

(76) Inventor: Kikuo Yamada, 403, Tiara Shimazuyama, 2-15 Higashi-Gotanda 1-chome, Shinagawa-ku, Tokyo 141-0022 (JP)

( * ) Notice: Subject to any disclaimer, the term of this patent is extended or adjusted under 35 U.S.C. 154(b) by 22 days.

(21) Appl. No.: 10/577,362

(22) PCT Filed: Oct. 27, 2004

(86) PCT No.: PCT/JP2004/015916

§ 371 (c)(1),
(2), (4) Date: Jun. 16, 2006

(87) PCT Pub. No.: WO2005/041741

PCT Pub. Date: May 12, 2005

(65) Prior Publication Data

US 2007/0157410 A1 Jul. 12, 2007

(30) Foreign Application Priority Data

Oct. 31, 2003 (JP) ..... 2003-372696

(51) Int. Cl.
*A47L 17/00* (2006.01)

(52) U.S. Cl. ..... 15/229.1; 15/229.4; 15/209.1

(58) Field of Classification Search ..... 15/229.1, 15/229.4, 209.1
See application file for complete search history.

(56) References Cited

U.S. PATENT DOCUMENTS 4,364,144 A * 12/1982 Moss et al. ..... 15/229.3
5,953,784 A * 9/1999 Suzuki et al. ..... 15/209.1
6,968,591 B2 * 11/2005 Tanaka ..... 15/229.1

FOREIGN PATENT DOCUMENTS

JP H02-008355 1/1990
JP 10-137168 5/1998

(Continued)

*Primary Examiner*—Joseph J Hail, III
*Assistant Examiner*—Shantese McDonald
(74) *Attorney, Agent, or Firm*—H. Jay Spiegel; Robert L. Haines

(57) ABSTRACT

A cleaner capable of more effectively collecting dirt or dust on a complex-shaped surface or in fine portions including corner sections. The cleaner has a cleaner body (2) and a fringe band (13). The cleaner body (2) is formed by superposing and fusion-bonding tongue-like sheet bodies (7, 8) together. The sheet bodies (7, 8) have peripheral edge sections forming a curvilinear outline, and the fusion-bonding is made at this peripheral edge sections. The fringe belt (13) is fusion-bonded to a surface section of the sheet body (7) of the cleaner body (2). An insertion section (20) from which a hand as a supporting body can be inserted is formed in the cleaner body (2), and a space section (21) is formed toward the bottom of the gap between the superposed sheet bodies (7,8). The fringe belt (13) is convexly curved in the direction from the insertion section (20) to the bottom of the space section (21). The fringe belt (13) has strip-like fringes (14) formed by arranging a large number of incisions in the outer side of the sheet body (7) and has a fringe-supporting section (10) for supporting the large number of the fringes (14). The fringe belt (13) is fusion-bonded to the sheet body (7) at the fringe-supporting section (10).

17 Claims, 13 Drawing Sheets

FOREIGN PATENT DOCUMENTS

| | | |
|---|---|---|
| JP | 10-328107 | 12/1998 |
| JP | 11-276402 | 10/1999 |
| JP | 2000-166841 | 6/2000 |
| JP | 2000-201876 | 7/2000 |
| JP | 2002-369783 | 12/2002 |

* cited by examiner

[FIG. 1]
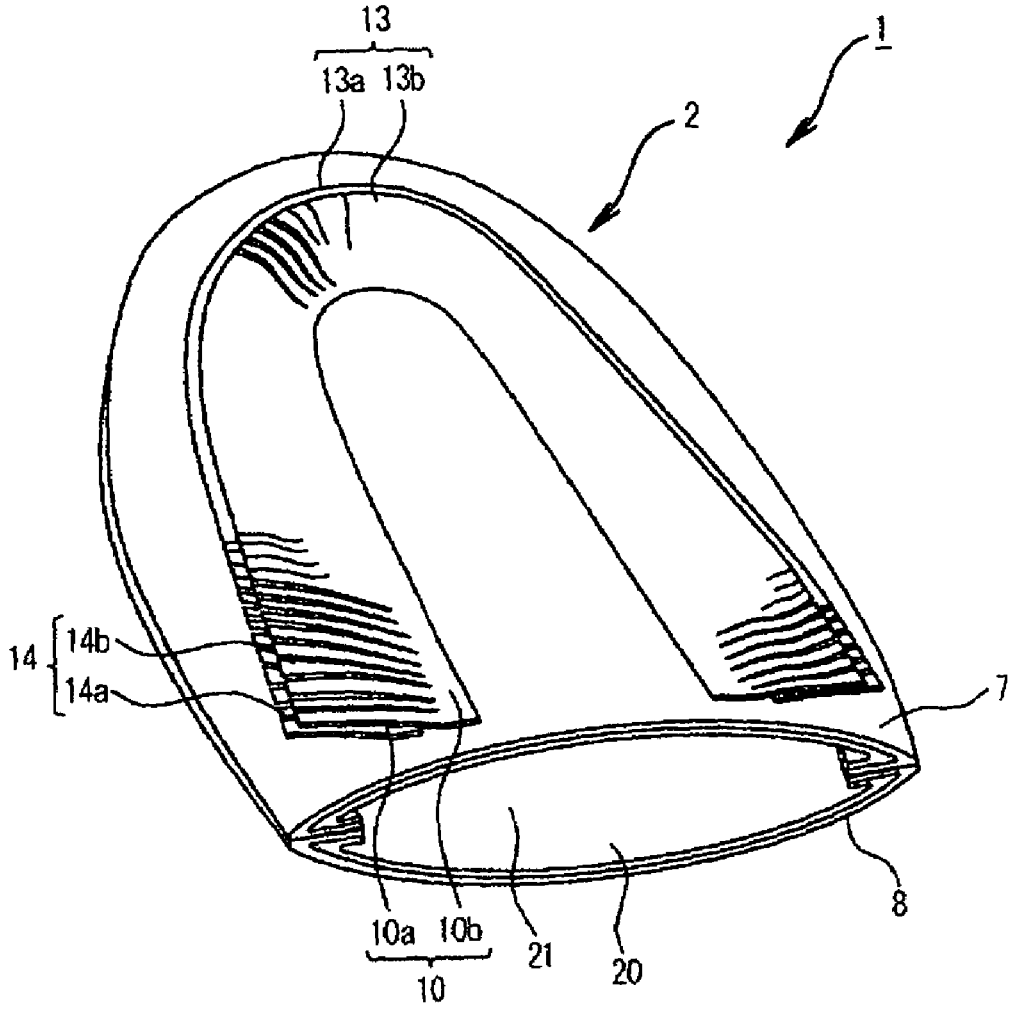

[FIG. 2]
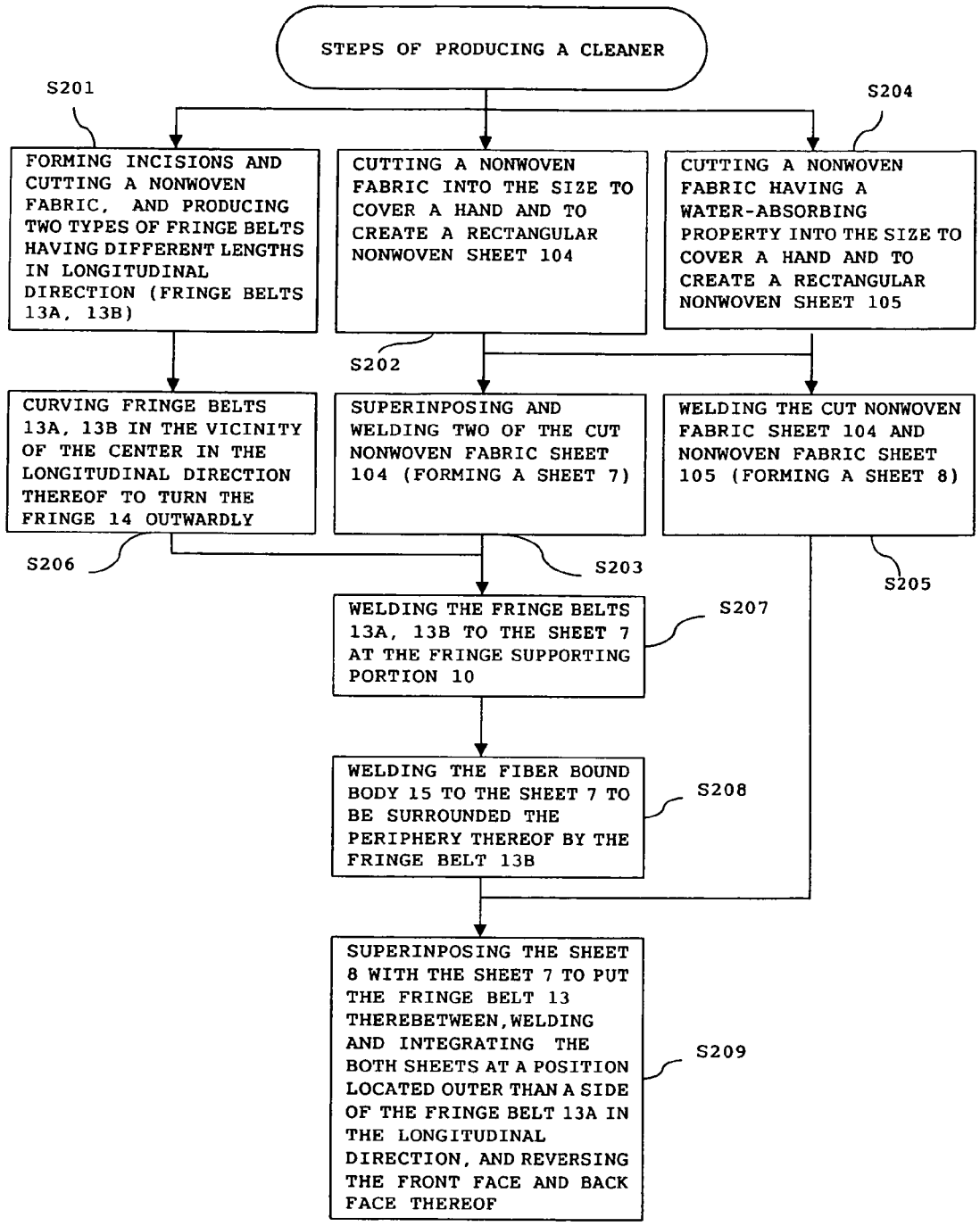

[FIG. 3]
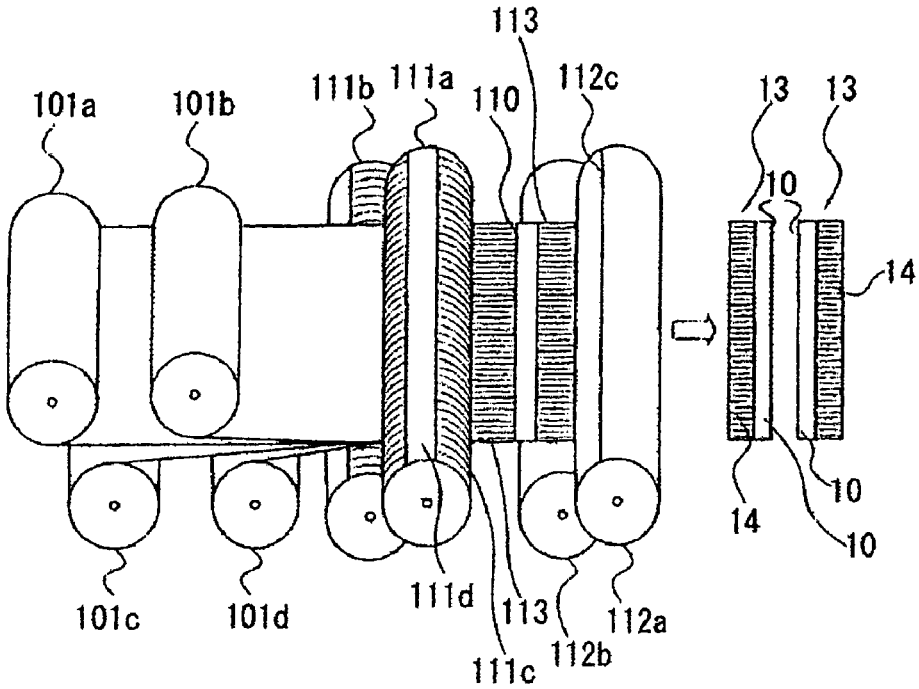

[FIG. 4]
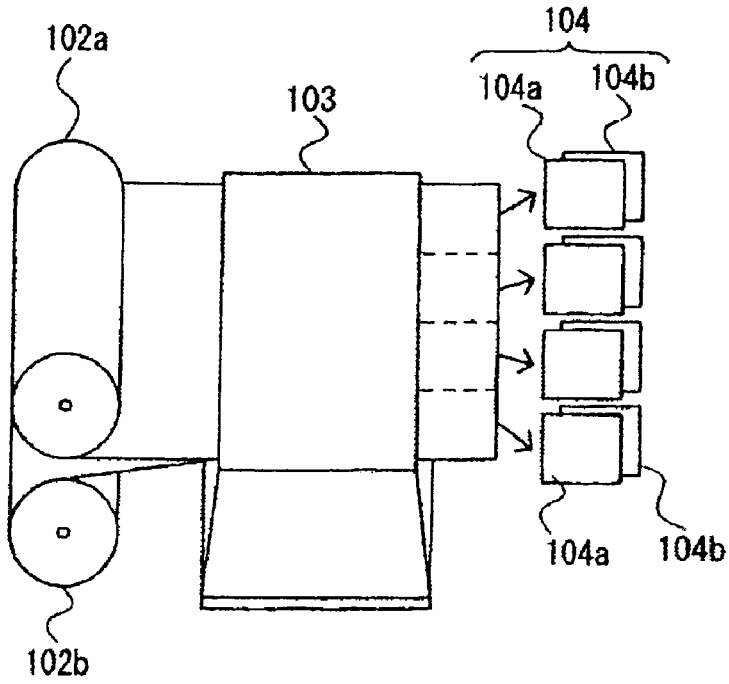
[FIG. 5A]
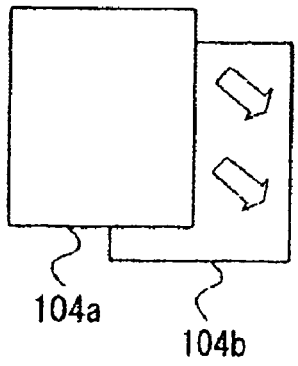

[FIG. 5B]
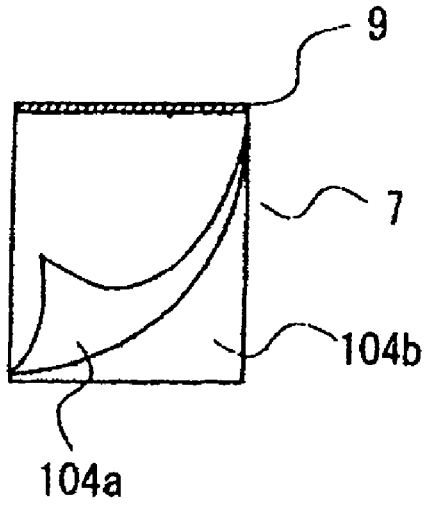
[FIG. 5C]
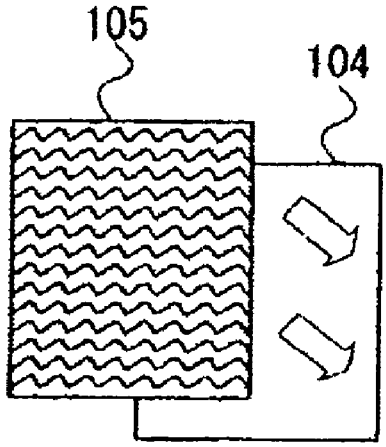

[FIG. 5D]
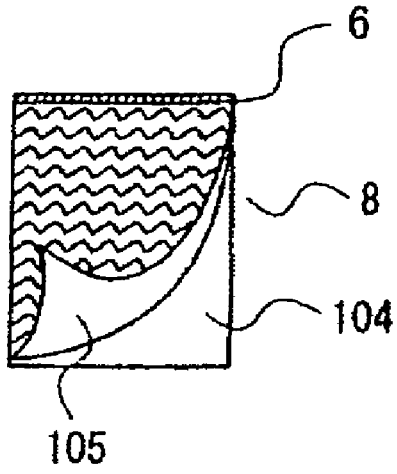
[FIG. 6A]
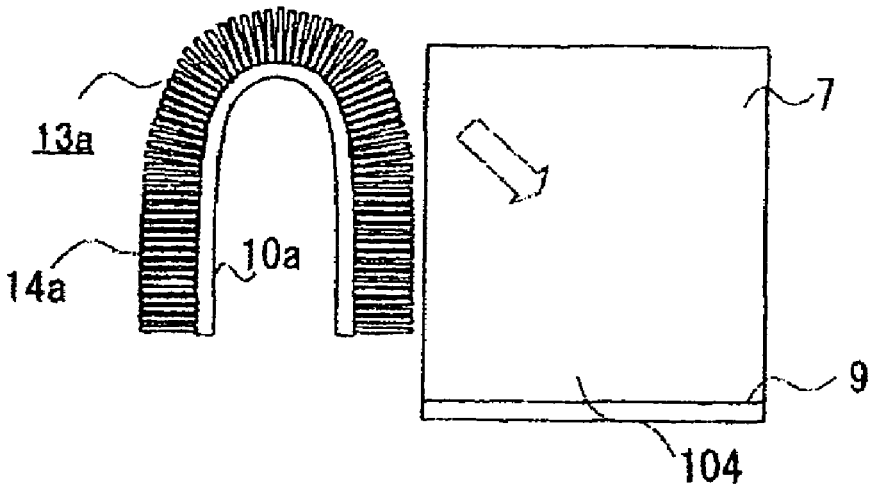

[FIG. 6B]
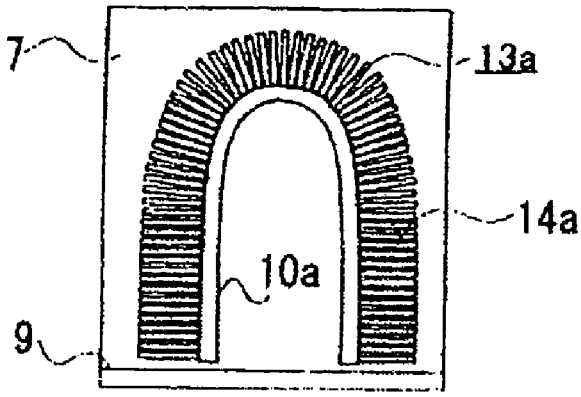
[FIG. 6C]
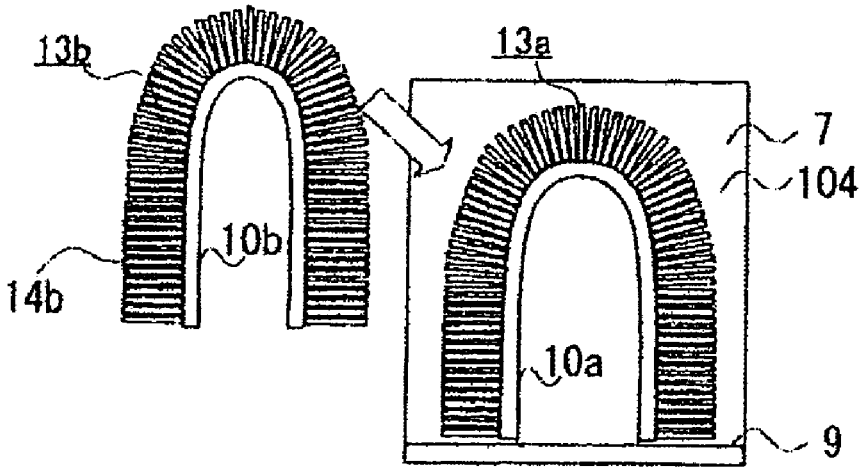

[FIG. 6D]
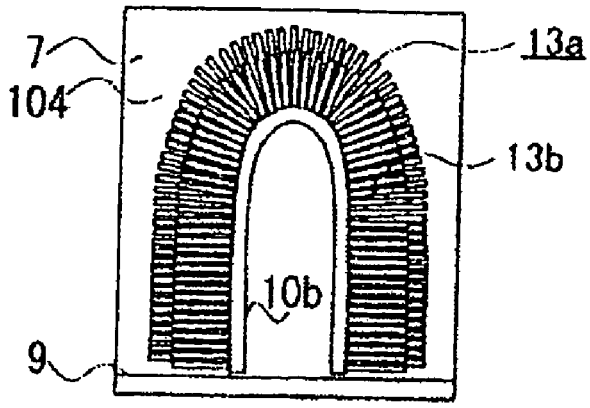
[FIG. 6E]
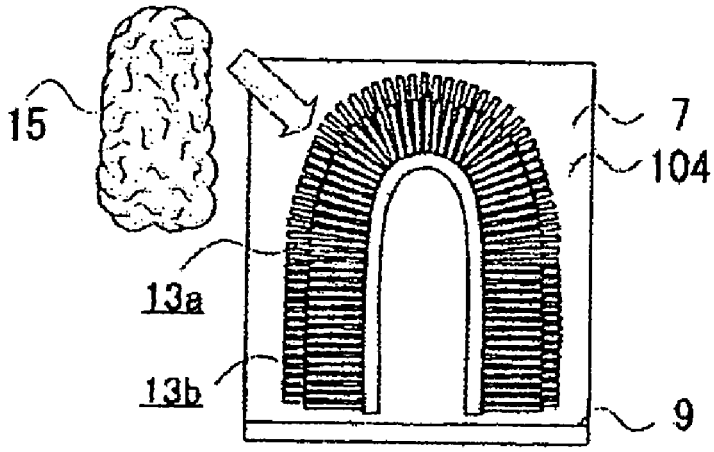

[FIG. 6F]
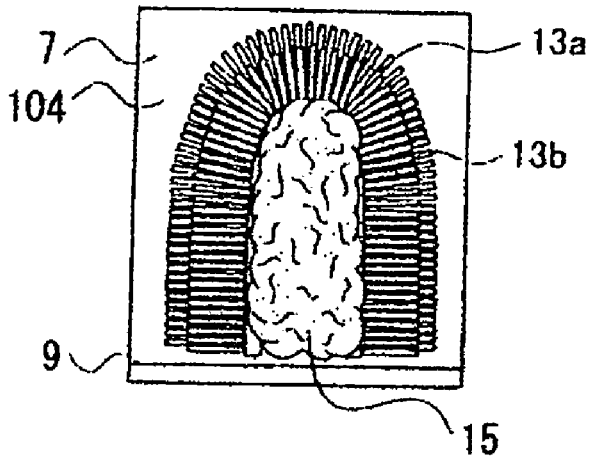
[FIG. 6G]
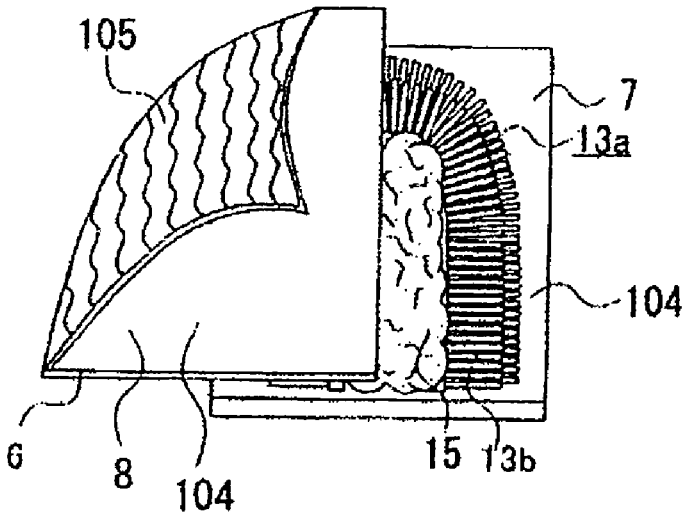

[FIG. 6H]
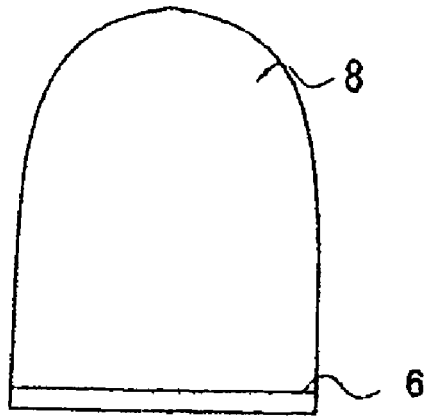
[FIG. 6I]
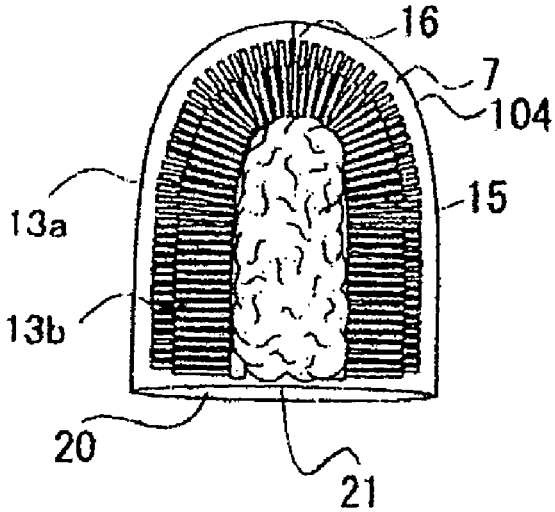

[FIG. 6J]
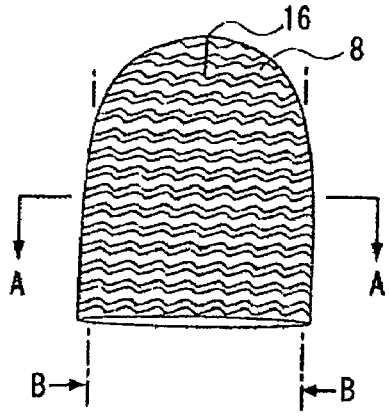
[FIG. 7]
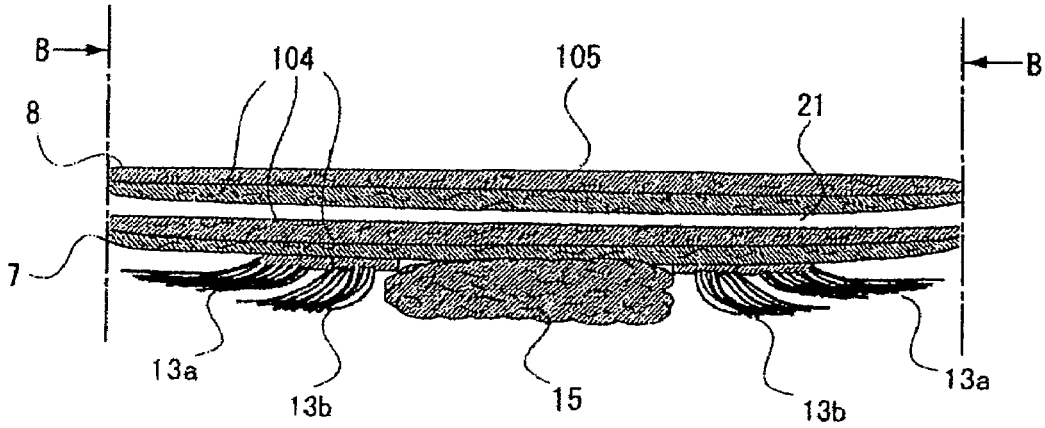

[FIG. 8]
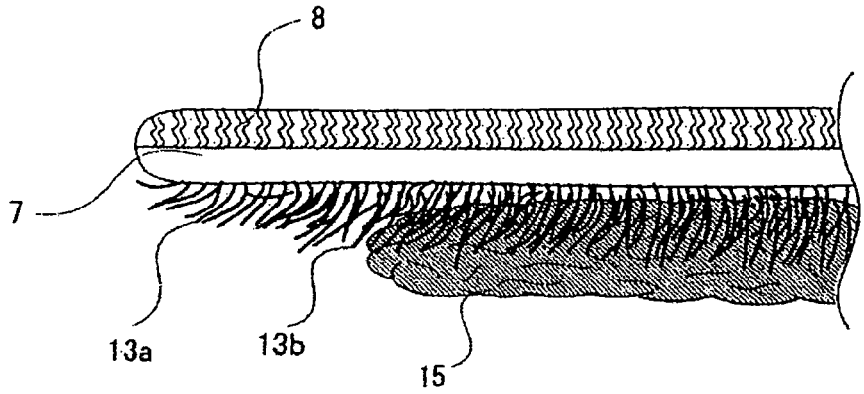
[FIG. 9]
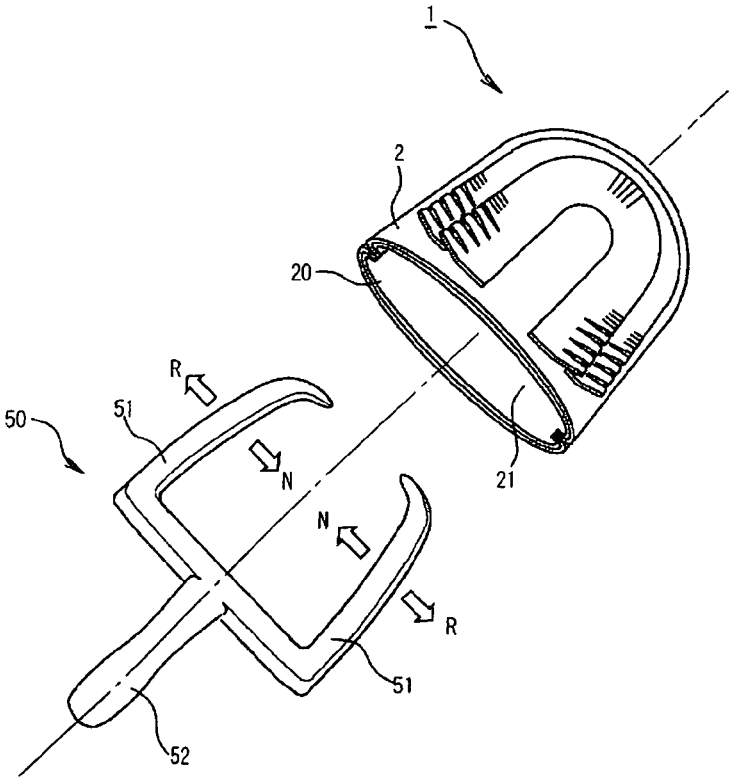

[FIG. 10]
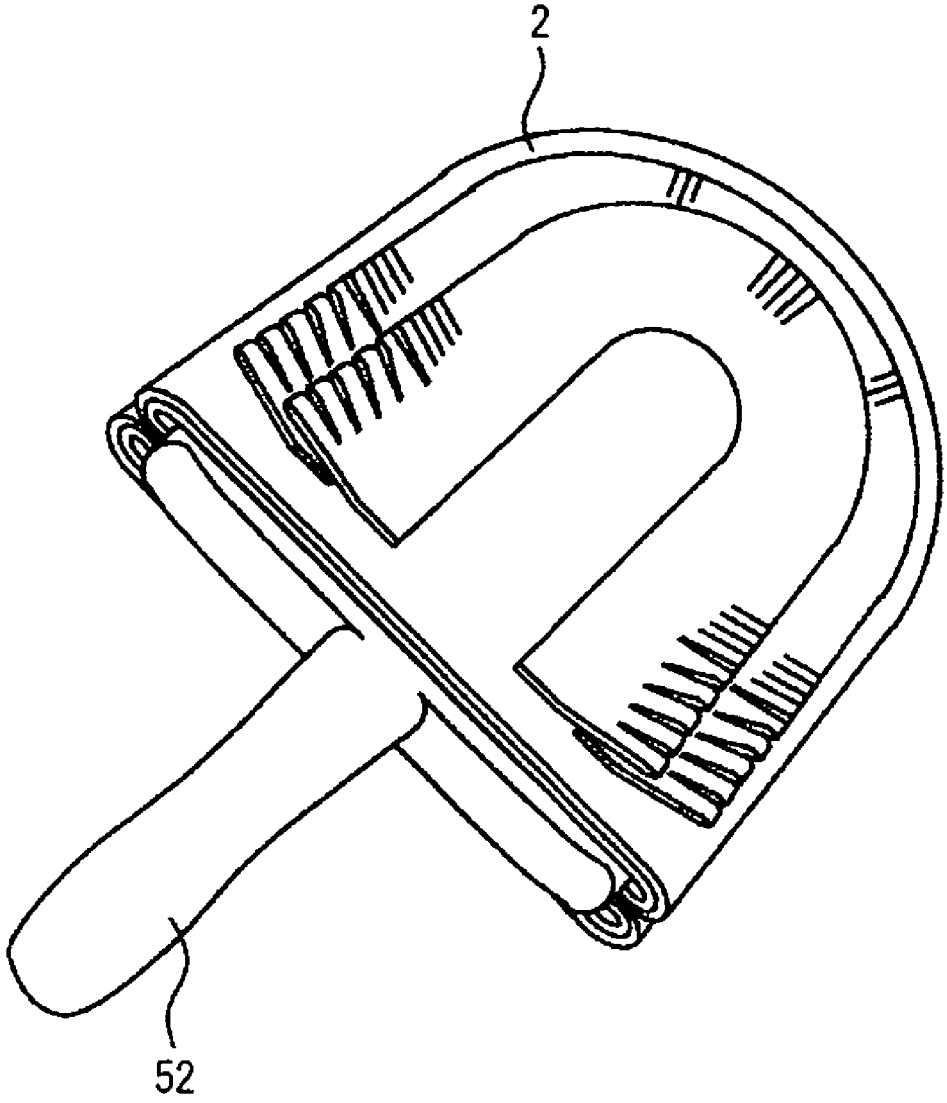

CLEANER

TECHNICAL FIELD

The present invention relates to a cleaner.

BACKGROUND ART

Hand mops provided with an opening at a mop section to insert directly a hand therein are known for cleaning articles near-at-hand such as furniture, tables, ornamental articles (see Patent Document No. 1, e.g. Japanese Patent Application Laid-Open No. H10-137168).

Such hand mops are capable of sweeping dirt or dust on a flat wide surface of an object to be cleaned such as a top board of a table, however, it is not capable of sufficiently sweeping dirt or dust on a complex-shaped surface or in fine sections.

Therefore, a pouch-shaped cleaner for easily and reliably cleaning a complex-shaped surface or fine sections has been provided (see Patent Document No. 2, e.g. Japanese Patent Application Laid-Open No. 2000-166841).

In the pouch-shaped cleaner, a back side and/or a palm side of a body of a pouch-shaped article to be inserted one's hand is made from a fabric of a fabric of ultra fine fiber, and a peripheral edge of the body of the pouch-shaped article is provided with oblong strip-shaped small pieces.

Patent Document No. 1: Japanese Patent Application Laid-Open No. H10-137168.

Patent Document No. 2: Japanese Patent Application Laid-Open No. 2000-166841.

In such the pouch-shaped cleaner, when sweeping dirt or dust on a surface of an object by moving the cleaner in the directions of back and forth and around, dirt or dust in a fine section can be cleaned to some degree, however, dirt or dust on the surface of the object cannot be cleaned by moving the cleaner in a vertical direction. Therefore, such the pouch-shaped cleaner has a problem that it is not easy to clean by raking out frontward dirt at the inmost portion of narrow space. Moreover, the pouch-shaped cleaner has a problem that dirt and the like in fine sections such as four corner sections inside of a box cannot be cleaned.

The present invention is provided to solve the problems described above, and objects thereof are to provide a cleaner capable of sufficiently sweeping dirt or dust accumulated on the complex-shaped surface or in the fine sections such as the inner four corner sections.

DISCLOSURE OF THE INVENTION

A cleaner of the present invention is characterized in that a fringe belt is fusion-bonded to a surface of a cleaner body which is provided with an insertion portion to which a support for supporting the cleaner is inserted.

According to the cleaner of the present invention, the belt-like fringe belt is fusion-bonded to at least one surface of the cleaner body which is provided with the insertion portion to which a hand or a handle as the support is inserted. When cleaning, a leading end portion of the fringe belt is fitted to a complex-shaped surface, so that dirt and the like on the surface can be swept, and the leading end portion of the fringe belt reaches fine sections such as inner corner sections, so that dust and the like accumulated in the corner sections can be swept sufficiently.

According to the cleaner of the present invention, the cleaner body receives an acting force directly from the hand acting as a support inserted from the insertion portion, and the cleaner can contact with the surface of an object to be cleaned by means of the strong force, so that dust on the surface of the object to be cleaned can be swept sufficiently. Moreover, in the case of an object to be cleaned such as a key board of a computer or the like which is easily broken by the acting force received from outside, the cleaner which is used by inserting the handle into the insertion portion, can contact with the surface of the object to be cleaned by means of an appropriate force, and dust can be swept without breaking the object to be cleaned.

According to the cleaner, by inserting the handle as the support into the insertion portion, even a place beyond a hand of a user can be cleaned easily.

According to the cleaner of the present invention, the fringe belt is formed a large number of fringes on a side in a longitudinal direction as well as a fringe supporting section for supporting each of the fringes, and may be fusion-bonded to the cleaner body at the fringe supporting section.

Such a cleaner is configured such that, for example, a plurality of incisions is provided of a side in a longitudinal direction on the fringe belt so as to form the fringes, and the fringe supporting section for supporting each of the fringes is formed, and the fringe supporting section is fusion-bonded to the cleaner body.

According to the cleaner of the present invention, the fringe of the fringe belt operates as a mop head string material, and thus can easily and sufficiently sweep dust or the like in, for example, portion such as the four corner positions inside a box. Moreover, since the fringes are formed on the fringe belt, the area on the object to be cleaned with which the fringe belt can contact increases, thus dirt or dust can be efficiently sweep by the fringe belt.

According to the cleaner of the present invention, the fringe belt may be made from a nonwoven fabric.

In this cleaner, if the fringe belt is made from a nonwoven fabric, the strength thereof is highly developed, and the cleaner can be produced relatively inexpensively, and can be washed easily. Moreover, static electricity is produced from fine fibers of the nonwoven fabric so that fine dust can be attracted to the fringe belt by the static electricity, thus dirt or dust can be swept even more reliably.

In the cleaner of the present invention, a plurality of fringe belts may be provided. In this case, each of the fringe belts is preferably provided to partially overlap with one another on the surface of the cleaner body in both inside and outside directions.

According to the cleaner, since the plurality of fringe belts is provided, fringe belts contact easily with the object to be cleaned, so that dirt or dust can be swept even more reliably.

Moreover, in case that the cleaner is configured such that the fringe belts are provided to partially overlap with one another on the surface of the cleaner body, each of the fringes can be allowed to contact evenly with certain width of region of the object to be cleaned. Thus, according to this cleaner, dirt or dust on the surface of the object to be cleaned can be swept evenly.

In the cleaner of the present invention, a fiber bound body obtained by bundling a large number of fibers, may be fusion-bonded to the fusion bonded surface of the fringe belt on the cleaner body.

By configuring the cleaner of the present invention in the above described manner, dust and the like can be swept by not only each of the fringe belts but also by the fiber bound body, thus the object to be cleaned can be cleaned more reliably.

Further, in the cleaner of the present invention, the fringe belt and the fiber bound body enable to be fusion-bonded to the surface of the cleaner body so as to surround a periphery of the fiber bound body by the fringe belt.

By providing the fiber bound body on the cleaner as described above, at the time of cleaning, firstly a large dirt is swept by the fringe belts, and small dirt which could not be removed is swept by the fiber bound body. Therefore, according to the cleaner, both of the fringe belt and fiber bound body operate more effectively.

According to such a cleaner, the fringe belts may be arranged sufficiently so as to partially surround the periphery of the fiber bound body.

In the cleaner of the present invention, a bundle of fibers having a water-absorbing property is available to configurate the fiber bound body.

According to this cleaner, since the fiber bound body has a water-absorbing property, dirt or dust can be swept easily even if the dirt or dust to be swept contains water.

The cleaner of the present invention may be configured such that the fiber bound body is fusion-bonded to the surface to which the fringe belt of the cleaner body was fusion-bonded, and the fringe belt is convexly curved in the direction of inserting the supporting body (referred to as "insertion direction") and is fusion-bonded to the surface section of the cleaner body.

According to the cleaner of the present invention, a space for fusion-bonding the fiber bound body is secured in the vicinity of a center portion on the surface of the cleaner body.

In the cleaner of the present invention, the cleaner body may be provided with a sheet material with a water-absorbing property at a back surface opposite to the surface where the fringe belt is fusion-bonded.

By configuring the cleaner of the present invention in the manner described above, dirt on a glass surface or the like, which could not be cleaned sufficiently by a conventional mop, can be cleaned by using a surface of the sheet material with the water-absorbing property which is provided on the cleaner body.

According to the cleaner of the present invention, the colors of the adjacent fringe belts may be different. Such a cleaner is pleasant to the eye, and can highlight dirt and dust on the object to be cleaned which are caught by the fringe belts when cleaning, so that the user can visually discriminate the degree of dirt caught by the fringe belts.

Moreover, in the cleaner of the present invention, the handle which is comprised of supporting rods and a grip section may be inserted as the supporting body from the insertion portion. Here, it is preferred that a plurality of supporting rods is provided, with spaces wider than the front width of the insertion portion therebetween. According to such a configuration, when inserting the supporting rods into the insertion portion, the space between the supporting rods can be narrowed, and a restoring force of the supporting rod acts after inserting the supporting rod into the insertion portion, whereby the handle can be prevented from being released from the insertion portion.

BRIEF DESCRIPTION OF THE DRAWINGS

FIG. 1 is a perspective view showing an embodiment of a cleaner according to the present invention;

FIG. 2 is a flowchart showing steps of a method of producing the cleaner in an embodiment of the present invention;

FIG. 3 is an explanatory diagram showing a method of producing the fringe belts configuring the cleaner of the present invention;

FIG. 4 is an explanatory diagram showing a method of producing a nonwoven fabric sheet forming a sheet configuring the cleaner of the present invention;

FIG. 5A is an explanatory view of a method of producing the sheet configuring the cleaner of the present invention;

FIG. 5B is an explanatory view of a method of producing the sheet configuring the cleaner of the present invention;

FIG. 5C is an explanatory view of a method of producing the sheet configuring the cleaner of the present invention;

FIG. 5D is an explanatory view of a method of producing the sheet configuring the cleaner of the present invention;

FIG. 6A is an explanatory diagram for explaining a step of producing the cleaner of the present invention;

FIG. 6B is an explanatory diagram for explaining a step of producing the cleaner of the present invention;

FIG. 6C is an explanatory diagram for explaining a step of producing the cleaner of the present invention;

FIG. 6D is an explanatory diagram for explaining a step of producing the cleaner of the present invention;

FIG. 6E is an explanatory diagram for explaining a step of producing the cleaner of the present invention;

FIG. 6F is an explanatory diagram for explaining a step of producing the cleaner of the present invention;

FIG. 6G is an explanatory diagram for explaining a step of producing the cleaner of the present invention;

FIG. 6H is an explanatory diagram for explaining a step of producing the cleaner of the present invention;

FIG. 6I is an explanatory diagram for explaining a step of producing the cleaner of the present invention;

FIG. 6J is an explanatory diagram for explaining a step of producing the cleaner of the present invention;

FIG. 7 is a cross-sectional view taken along a line A-A in a region between lines B and B in FIG. 6J;

FIG. 8 is a partial side view of FIG. 6J;

FIG. 9 is an exploded perspective view showing other embodiment of the cleaner of the present invention; and FIG. 10 is a perspective view showing said other embodiment of the cleaner of the present invention.

BEST MODE FOR CARRYING OUT THE INVENTION

As shown in FIG. 1, a cleaner 1 of the present invention comprises a cleaner body 2, which is obtained by superimposing and fusion-bonding tongue-like sheets 7, 8 at peripheral portion of the sheets 7, 8 which form a curvilinear outline, and a fringe belt 13 which is fusion-bonded to a surface of the sheet 7 of the cleaner body 2.

In the cleaner body 2, an insertion portion 20 into which a hand as a supporting body is formed, and further an interspace 21 is formed in a gap between the superimposed sheets 7, 8, such as to extend from the insertion portion 20 toward the bottom. Specifically, the interspace 21 is formed such as to extend in a direction of insertion from the insertion portion 20.

The fringe belt 13 comprises a first fringe belt 13*a* and a second fringe belt 13*b*. The first fringe belt 13*a* and the second fringe belt 13*b* are convexly curved in a direction extending from the insertion portions 20 respectively toward the bottom of the interspace 21, and are arranged on a surface of at least one (sheet 7) of the sheets 7, 8 so as to be overlapped with one another in a direction from the inside to the outside. In this case, the first fringe belt 13*a* is disposed outer than the second fringe belt 13*b* in an outer direction. The outer direction is a direction extending from the center of a surface of the sheet 7 toward the outside of the sheet 7, and the direction opposite to the outer direction is an inner direction.

In the first fringe belt 13*a*, a large number of incisions are formed on a side in a longitudinal direction so as to form oblong fringes 14 (14*a*), and a supporting section 10 (10*a*) for supporting the large number of fringes 14*a* is formed. Moreover, the first fringe belt 13*a* is fusion-bonded to the sheet 7 at the fringe supporting section 10*a*.

The second fringe belt 13*b* is formed fringes 14*b* and a fringe supporting body 10*b*, as same as the first fringe belt 13*a*.

The length of the incisions on the first fringe belt 13*a* and the second fringe belt 13*b*, i.e. the length of the fringes 14 (14*a*, 14*b*) in the first fringe belt 13*a* and the second fringe belt 13*b*, is appropriately selected, and is preferably 0.8 cm through 3 cm. If the length of the incisions is too short, the cleaner 1 may not be able to allow the fringes 14 to reach deeply an inmost portion of a fine space when cleaning an object to be cleaned, and thus may not be able to collect dirt or dust sufficiently. If the length of the incisions is too long, the fringes 14 may be easily entangled with one another, thus sufficiently good operability of the cleaner 1 may not be obtained at the time of cleaning.

The space between the incisions on the first fringe belt 13*a* and the second fringe belt 13*b*, i.e. the width of the fringe 14, can be selected accordingly, but is preferably 0.5 mm through 5 mm. If the space between the incisions is too narrow, the width of the fringe 14 may become too narrow and fragile. If the space between the incisions is too wide, the number of fringes 14 to be formed may be small and the area of the fringe belt 13, which can contact with the object to be cleaned, may be reduced, and dirt or dust may not be swept sufficiently.

In the fringe belt 13 the incision of the fringes 14 is not limited to a straight line to form the oblong fringes, thus the incision may be formed to have a continuous serrated shape or a continuous wave-like shape, or alternatively may be formed by combining a plurality of such shapes.

The fringe 14 formed on the fringe belt 13 is not limited to form by providing the fringe belt 13 with the incisions, and may be formed by providing cutout with a predetermined width and a predetermined depth.

The embodiment of the present invention describes the case in which the cleaner 1 is provided with two fringe belts 13. However, the number of the fringe belts 13 to be disposed is not limited to the above number, and thus can be selected in accordance with the length of the fringe belt 13 in a longitudinal direction or the width of same. Thus it may be available one or three or more fringe belts.

The embodiment of the present invention describes the case in which the cleaner 1 is configured such that the fringe belt 13 is convexly curved in an insertion direction and provided on the surface of the sheet 7. However, the form thereof is not limited to this embodiment, thus in the cleaner 1 the fringe belt 13 may be formed into a line, wave, or spiral and provided on the surface section of the sheet 7.

However, in the case of the cleaner 1 of the present invention in which the fringe belt 13 is convexly curved in the insertion direction and provided on the surface of the sheet 7, it is preferred that the size of a side in an inner direction (referred to as "inner size") of the second fringe belt 13*b* be substantially smaller than the inner size of the first fringe belt 13*a*. In this case, fusion-bonding of the second fringe belt 13*b* to the sheet 7 becomes easy in an inner position in the direction from the inside to the outside with respect to a position where the first fringe belt 13*a* is fusion-bonded to the sheet 7. The fringe belts can be provided in succession even in the vicinity of the center of the surface section of the sheet 7, with almost no space provided therebetween. Furthermore, a large number of fringe belts 13 can be arranged efficiently on the surface of the sheet 7.

Moreover, in the present invention, a nonwoven fabric sheet is numerated to use as the materials of the fringe belt 13 and sheets 7, 8 include, and the fringe belt 13 and the sheets 7, 8 may be formed from a single nonwoven fabric sheet or by superimposing a plurality of nonwoven fabric sheets.

The materials of the fringe belt 13 and the sheets 7, 8 can be selected accordingly from materials which can form the nonwoven fabric sheet, thus a spunlace nonwoven fabric, spunbond nonwoven fabric, thermalbond nonwoven fabric, air-through bond nonwoven fabric, point bond nonwoven fabric, or the like can be used specifically. However, the nonwoven fabric sheet used for configuring the sheets 7, 8 is preferably a thermalbond nonwoven fabric. The reason is because the fringe belt 13 can be bonded to and integrated with the sheet 7 by means of thermal bonding.

If the fringe belt 13 or the sheets 7, 8 are obtained by superimposing a large number of nonwoven fabric sheets, nonwoven fabric sheets of different materials may be used to compose thereof by superimposing each other.

A staple fiber configuring the nonwoven fabric of the fringe belt 13 or the sheets 7, 8 is not particularly limited, thus, for example, a fiber such as propylene, polyethylene, or polyethylene terephthalate, or a core-in-sheath type composite fiber or a side-by-side type composite fiber can be specifically used.

In the cleaner 1 of the present invention, a fiber bound body, which is obtained by bundling a large number of fibers, may be bonded to the surface section of the sheet 7 provide with the fringe belt 13. The width (thickness) of each of the fibers configuring the fiber body can be selected accordingly, but is preferably thinner than the width of the fringes 14 formed on the fringe belt 13. If the width of each of the fibers configuring the fiber bound body is thinner than the width of the fringe, small dirt or dust which cannot be swept by the fringes 14 can be swept by the fibers of the fiber bound body.

Moreover, it is preferred that the fiber bound body and the fringe belt be fusion-bonded to the sheet 7 such that the periphery of the fiber bound body is surrounded entirely or partially by the fringe belt 13. At this moment, the fiber bound body is fusion-bonded to the cleaner body 2 in a position inner than that of the fringe belt 13 in the direction from the inside to the outside of the sheet 7.

According to such a cleaner, dirt or dust contacts first with the fringes 14 of the fringe belt 13 at the time of cleaning, and substantially large dirt are swept by the fringes 14 of the fringe belt 13. Dirt or dust particles that are so small that they can pass through the fringes 14 can be swept by the fiber bound body. Therefore, both the fiber bound body and the fringe belt can effectively play their roles.

The fibers configuring the fiber bound body are not particularly limited, thus fibers same as those used in the nonwoven fabric sheets configuring the sheets 7, 8 can be used specifically.

Moreover, for the fibers configuring the fiber bound body, fibers having a water-absorbing property may be used, and specific examples include rayon, cotton, hemp, or the like. According to the cleaner 1 provided with such a fiber bound body, even if there is dirt or dust containing some water on the object to be cleaned, the fiber bound body can absorb the water and the fringe belt 13 or the fiber bound body can sweep the dirt or dust, thus cleaning of the object to be cleaned can be performed even more efficiently.

The fiber bound body may be formed high by bundling the fibers so that they do not break apart from one another, or may be formed into a sheet by bundling and compressing the fibers.

In the cleaner body 2 of the cleaner 1, the back of the surface to which the flange belt 13 is fusion-bonded, i.e. a surface of the sheet 8, may be provided with a sheet material having a water-absorbing property. Specific examples of the sheet material having a water-absorbing property include rayon and other spunlace nonwoven fabrics made from fibers having a water-absorbing property.

The size of the cleaner body 2 is preferably the size which can secure the interspace 21 running from the insertion portion 20 to the bottom so that the hand can be inserted from the insertion portion 20. Furthermore, the shape of the cleaner body 2 can be selected accordingly, and examples include not only the tongue-like shape as described in the embodiment but also a polygonal shape, circular shape, semicircular shape, triangular shape, mitten-like shape, glove-like shape, rectangular or oblong shape, and the like.

In the cleaner body 2 that a finger stop section may be formed by partially fusion-bonding the sheet bodies, which are superimposed in a direction running from the backmost position of the interspace 21 toward the insertion portion 20, to form a line of thread.

Moreover, the cleaner body 2 is not limited to the above embodiment where the sheets 7, 8 are superimposed, thus an insertion portion into which a supporting body such as a hand can be inserted may be formed in a ring-like portion by fusion-bonding a ring-like belt to the sheet 7.

Examples of method of fusion-bonding between the sheet 7 and the sheet 8, between the sheet 7 and the fringe belt 13, and the sheet 7 and the fiber bound body specifically include a method of thermal fusion-bonding by means of impulse welding or heat sealing, a method of fusion-bonding by means of application of an adhesive such as a hot-melt adhesive, and a method of thermal adhesion by means of ultrasonic irradiation using an ultrasonic adhering device.

The cleaner 1 is produced by the following production method. Here, FIG. 2 through FIG. 8 are used to provide a detailed description of the production method for the embodiment in which the fiber bound body is fusion-bonded to the cleaner 1 which is comprised of the fringe belt 13 configured from four superimposed nonwoven fabrics and the cleaner body 2 to which the sheets 7, 8 are fusion-bonded, each of the sheets 7, 8 being obtained by superimposing two nonwoven fabrics, and moreover the back side of the surface of the cleaner body 2, to which the fringe belt 13 is fusion-bonded, is provided with the sheet material having a water-absorbing property.

FIG. 2 is a flowchart showing the method of producing the cleaner 1 in the present invention. FIG. 3, FIG. 4, FIG. 5A through FIG. 5D, FIG. 6A through FIG. 6J are explanatory diagrams for explaining the method of producing the cleaner 1.

First of all, the fringe belt 13 (13*a*, 13*b*) and the sheets 7, 8 are produced by superimposing and cutting a plurality of nonwoven fabrics.

The fringe belt 13 is produced as follows.

Nonwoven fabric feed rolls 101*a*, 101*b*, 101*c*, and 101*d* around which long nonwoven fabrics are wrapped feed the nonwoven fabrics in succession as shown in FIG. 3, and the fed nonwoven fabrics are superimposed on one another and pass through a processing roll 111 (111*a*, 111*b*). A processing section 111*c*, which is provided with a large number of processing blades having a predetermined space therebetween in a width direction of the nonwoven fabric, and a non-processing section 111*d* with no processing blades are formed on the processing roll 111. When the superimposed nonwoven fabrics pass through between the processing rolls 111*a* and 111*b*, a large number of spaced-apart incisions are formed in the width direction of the nonwoven fabrics by the processing blades provided on the processing section 111*c*, whereby a processing region 113 is formed. At this moment, the processing regions 113 are formed by the non-processing section 111*d*, with a predetermined space therebetween in a longitudinal direction, and a non-processing region 110 with no incisions is formed between each of the processing regions.

The nonwoven fabrics which pass through the processing roll 111 are pass through a cut roller 112 (112*a*, 113*b*) having shear blades 112*c* in the width direction of the nonwoven fabric. When passing through between the cut rollers 112*a* and 112*b*, the nonwoven fabric is cut at substantially a middle position between each of the processing region 113 and the non-processing region 110 by the shear blades 112*c*. Accordingly, the fringe 14 and the fringe supporting section 10 are formed on the nonwoven fabric, and then the fringe belt 13 is formed.

For the fringe belt 13 provided in the cleaner 1, the first fringe belt 13*a* and the second fringe belt 13*b* are produced, and the second fringe belt 13*b* is produced so that the length thereof in a longitudinal direction is shorter than that of the first fringe belt (S201 in FIG. 2).

Two kinds of the fringe belts, i.e. the first fringe belt 13*a* and the second fringe belt 13*b*, which have different lengths in the longitudinal direction, can be produced by reducing the length in the longitudinal direction of a part of the fringe belt 13 produced in the above method, where a fringe belt whose length in the longitudinal direction is long is used for the first fringe belt 13*a*, and a fringe belt whose length in the longitudinal direction is short is used for the second fringe belt 13*b*.

The second fringe belt 13*b* may be produced separately from the first fringe belt 13*a* by using a nonwoven fabric narrower than the one used for producing the first fringe belt 13*a*.

The sheets 7, 8 are produced as follows.

Nonwoven fabric feed rolls 102*a* and 102*b* around which long nonwoven fabrics are wrapped feed the nonwoven fabrics respectively in succession as shown in FIG. 4. The fed nonwoven fabrics are superimposed on one another and pass through a cutting machine 103, whereby a nonwoven fabric sheet 104 (104*a*, 104*b*), which is cut into rectangles larger enough to cover over the palm or back of a hand, can be obtained (S202 in FIG. 2).

As shown in FIG. 5A and FIG. 5B, the sheet 7 is produced by integrating the nonwoven fabric sheets 104*a* and 104*b* by superimposing the nonwoven fabric sheets 104*a* and 104*b* which are cut into rectangles (FIG. 5A), and forming a welded section 9 (FIG. 5B) by partially impulse-welding thereof (S203 in FIG. 2).

Furthermore, the sheet 8 is produced as follows.

First, a nonwoven fabric having a water-absorbing property is used as the long nonwoven fabric wrapped around the nonwoven fabric roll 102*b*, and a nonwoven fabric sheet 105, which is cut into rectangles, is prepared as in the case of the sheet 7. Then, as shown in FIG. 5C and FIG. 5D, the nonwoven fabric sheet 104 and the nonwoven fabric sheet 105 are integrated by being superimposed on each other (FIG. 5C), and impulse-welded partially (FIG. 5D) to form a welded section 6, whereby the sheet 8 is produced (S204, S205 in FIG. 2).

The fringe belts 13*a*, 13*b*, and the sheets 7, 8 obtained in the manner described above are integrated as show in FIG. 6A through FIG. 6J, whereby the cleaner 1 is formed.

As shown in FIG. 6A and FIG. 6C, the first fringe belt 13*a* and the second fringe belt 13*b* are curved in the vicinity of the center in the longitudinal direction such that the fringe 14 runs in the outer direction and the fringe supporting section 10 runs in the inner direction. In this case, the length in the longitudinal direction of the second fringe belt 13*b* is shorter than that of the first fringe belt 13*a*, thus the inner size of the curved second fringe belt 13*b* can be easily reduced to be a little smaller than the inner size of the curved first fringe belt 13*a*.

Both ends in the longitudinal direction of the first fringe belt 13*a* are disposed on the surface section of the sheet 7 so as to face the welded section 9 of the sheet 7, and are subjected to ultrasonic adhesion at the fringe supporting section 10, and are welded to the sheet 7 (FIG. 6B).

Next, as shown in FIG. 6C and FIG. 6D, the external periphery of the second fringe belt 13*b* is surrounded by the first fringe belt 13*a*, disposed on the surface section of the sheet 7 so as to be partially superimposed with the first fringe belt 13*a*, and welded to the sheet 7 as in the case of the first fringe belt 13*a* (S207 in FIG. 2).

Next, the fiber bound body 15 is prepared. The fiber bound body 15 is produced by bundling a large number of fibers so that they do not break apart from one another.

As shown in FIG. 6E and FIG. 6F, the fiber bound body 15 is disposed on the surface section of the sheet 7 so that the periphery thereof is surrounded by the second fringe belt 13*b*, and is subjected to ultrasonic adhesion to be welded to the sheet 7 (S208 in FIG. 2).

The sheet 7 and the sheet 8 are superimposed on each other (FIG. 6G) so that the nonwoven fabric sheet 105 of the sheet 8 faces the surface of the sheet 7 to which the fringe belt 13 is welded, and at the same time the welded section 9 of the sheet 7 and the welded section 6 of the sheet 8 are allowed to face oppositely. The both sheets 7, 8 are integrated with each other by means of impulse welding at a position located somewhat outer than a position of a leading end in the outer direction in the fringe 14 of the first fringe belt 13*a*, and an outer side of the obtained welded position is cut to form a welded body (FIG. 6H). At this moment, the welded section 9 and the welded section 6 are not welded to each other. The method of producing the cleaner of the present invention is not limited to the case in which welding and cutting are performed separately as described in this production example, thus the sheet 7 and the sheet 8 may be superimposed on each other and melted.

The front face and the back face of thus obtained welded body are reversed, and the surface of the nonwoven fabric sheet 105 of the sheet 8 and the surface of the sheet 7 provided with the fringe belt 13 become the front surfaces respectively, the insertion portion 20 is formed in the position of the welded section 9 and the welded section 6, and the interspace 21 is formed at the inmost of the insertion portion 20. Then, the sheets 7, 8 are welded in the form of a line of thread in a direction running from the bottom of the space section 21 toward the insertion portion 20, to form a finger stop section 16 (FIG. 6I and FIG. 6J), whereby the cleaner 1 as shown in FIG. 7 and FIG. 8 is produced (S209 in FIG. 2). FIG. 7 is a cross-sectional view taken along the line A-A in a region between B and B in FIG. 6J. Moreover, FIG. 8 is a partial side view of FIG. 6J.

In the method of producing the cleaner of the present invention, when integrating the sheet 7 welded the fringe belt 13 and the fiber body 15, with the sheet 8, the sheet 7 and the sheet 8 are superimposed on each other so as to face the fringe belt 13 welded surface to the surface of the sheet 7 with the nonwoven fabric sheet 104 of the sheet 8, and to face oppositely the welded section 9 of the sheet 7 with the welded section 6 of the sheet 8 then, the sheets 7, 8 may be subjected to impulse welding and integrated with each other as in the above-described production method.

In this case, the nonwoven fabric sheet 105 of the sheet 8 and the surface of the sheet 7 provided with the fringe belt 13 become the front surface at the time of impulse welding of the sheets 7, 8, thus the step of reversing the front surface and the back surface as in the above production method is not required to produce the cleaner 1.

The cleaner 1 provided in accordance with the present invention can be used by inserting a hand into the cleaning body 2 from the insertion portion 20 and touching the object to be cleaned.

The cleaner 1 of the present invention can also be used as a cleaner with a handle where, instead of inserting a hand from the insertion portion 20, a handle as the supporting body is inserted from the insertion portion 20 into the cleaner body 2 and attached to the cleaner 1.

The handle is detachably attached to the cleaner 1. Plastic, metal, wood, or the like can be used as the material of the handle, but the plastic is preferred because of its lightweight and low cost. When using the plastic as the material, a polyolefin resin such as a polyethylene resin or polypropylene resin is preferred for easy molding.

Preferred examples of the handle to be attached to the cleaner 1 are described with reference to FIG. 9 and FIG. 10. FIG. 9 and FIG. 10 show an example of a preferred embodiment of the handle of the cleaner of the present invention.

A handle 50 comprises supporting rods 51 and a grip 52. The space between the supporting rods 51, 51 provided on the handle 50 is preferably wider than the front width of the insertion portion 20. According to such a configuration, when inserting the supporting rods 51, 51 into the insertion portion 20, the space between the supporting rods 51, 51 can be narrowed in N direction as shown in FIG. 9, and a restoring force of the supporting rods 51, 51 acts outwardly (R direction) after inserting into the insertion portion 20, whereby the supporting rods 51, 51 are securely held inside of the interspace 21 (FIG. 10), and the supporting rods 51, 51 are prevented from being released easily from the insertion portion 20 at the time of cleaning.

In the two supporting rods 51, 51 outer edges thereof may be provided with protruding portions which partially protrude in the R direction, or may be provided with cutout portions obtained by cutting the supporting rods 51 in the N direction in the form of a mound. If such a protruding portions or cutout portions are provided, the two supporting rods 51, 51 can be easily inserted into the insertion portion 20, and the supporting rods 51, 51 are not released from the insertion portion 20 easily, thus the supporting rods 51, 51 can be prevented, further reliably, from being released easily from the insertion portion 20 at the time of cleaning.

INDUSTRIAL APPLICABILITY

The cleaner of the present invention is extremely effective in terms of its usability when sufficiently cleaning a complex-shaped surface or fine sections such as corner portions.

The invention claimed is:

1. A cleaner comprising:

a cleaner body comprising first and second sheets partially connected to one another along curved peripheries thereof, and said sheets forming therebetween an opening at an unconnected portion of the peripheries into which a supporting body for supporting the cleaner is inserted;

at least one U-shaped fringe belt comprising at least one further sheet and having a large number of fringes transversely and partially provided on a side of the further sheet in a longitudinal direction, and a fringe supporting section for supporting each of the fringes, the fringes extending from the fringe supporting section, said fringe belt being convexly curved generally corresponding to said curved peripheries of said first and second sheets and extending in a direction of insertion of the supporting body, the fringe supporting section of said fringe belt being fusion-bonded to a surface of solely the first sheet of the cleaner body along a curved line of a peripheral shape of the first sheet with said fringes terminating short of said curved periphery of said first sheet; and a fiber bound body comprising a large number of fibers bundled, and said fiber bound body being fusion-bonded solely to the surface of the first sheet of the cleaner body on which the fringe belt is fusion-bonded, and being partially surrounded by an inner periphery of the U-shaped fringe belt.

2. The cleaner according to claim 1, wherein the fringe belt is made of a nonwoven fabric.

3. The cleaner according to claim 1, further comprising a plurality of U-shaped fringe belts being provided side by side on the first sheet of the cleaner body and partially overlapping with one another along the curved line of the peripheral shape of the first sheet.

4. The cleaner according to claim 1, wherein the fiber bound body is made of a bundle of fibers having a water-absorbing property.

5. The cleaner according to claim 1, further comprising a sheet material having a water-absorbing property and being provided at a rear surface of the second sheet of the cleaner body opposite to the surface of the first sheet on which the fringe belt is mounted.

6. The cleaner according to claim 1 wherein the supporting body is comprised of a handle having supporting rods which have a shape corresponding to an inner peripheral shape within the opening of the cleaner body and said shape of said rods facilitating insertion into said opening and a grip connected to the supporting rods.

7. A cleaner comprising:

a hollow fabric body comprising first and second sheets partially connected along respective curved peripheries thereof, and said sheets having substantially flat shapes and an open end at an unconnected portion of the peripheries between the sheets, a U-shaped fringe belt comprising a large plurality of fringe elements and a continuous supporting section integrated with a portion of the fringe elements, the elongated fringe belt being curvedly disposed and fusion bonded solely to the first sheet of the hollow fabric body in a convex arc shape following a peripheral shape of the hollow fabric body, with said fringe elements terminating short of said curved periphery of said first sheet, a fiber bundle disposed on the curved continuous supporting section of the fringe belt and bonded solely to the surface of the first sheet of hollow fabric body and partially surrounded by the fringe belt, and a supporting body comprising a handle having supporting means and being insertable into the hollow fabric body through the open end and a grip connected to the supporting means.

8. The cleaner according to claim 7, further comprising a plurality of fringe belts bonded to the first sheet of the hollow fabric body such that the fringe elements of each fringe belt are overlapped.

9. The cleaner according to claim 7, further comprising a water absorbing sheet material applied to a rear surface of the second sheet of the hollow fabric body opposite to the surface on the first sheet on which the fringe belt is bonded.

10. A cleaner, comprising a cleaner body having first and second sheets partially connected together along respective curved peripheries thereof, said sheets having an opening therebetween, an insertion portion communicating with the opening, said first and second sheets each having front and rear surfaces; a convexly curved U-shaped fringe belt having a plurality of fringes on a side thereof and being disposed curvedly on and fusion-bonded solely to the front surface of the first sheet of the cleaner body with said fringes terminating short of said curved periphery of said first sheet; a supporting body for supporting the cleaner body comprising a handle and supporting rods to be inserted from the opening into the insertion portion of the cleaner body; and a sheet material having a water-absorbing property provided at the rear surface of the second sheet opposite to the front surface on the first sheet where the fringe belt is mounted on the cleaner body.

11. The cleaner according to claim 10, wherein the fringe belt is comprised of a large number of fringes and an elongated fringe supporting section for supporting one end portion of the fringes to extend another end portion of the fringes from the elongated fringe supporting section, and said fringe belt being fusion-bonded to the first sheet of the cleaner body at the elongated fringe supporting section along a peripheral shape of the cleaner body.

12. The cleaner according to claim 10, wherein the fringe belt is made of a nonwoven fabric.

13. The cleaner according to claim 10, further comprising a plurality of fringe belts disposed side by side on the front surface of the first sheet of the cleaner body to partially overlap one another in a direction from inside to outside.

14. The cleaner according to claim 10, further including a fiber bound body made of a large number of fibers bundled, and fusion-bonded solely to the front surface of the first sheet of the cleaner body to which the fringe belt is attached.

15. The cleaner according to claim 14, wherein the fiber bound body is fusion-bonded solely to the front surface of the first sheet of the cleaner body to be at least partially surrounded by an inner peripheral portion of said fringe belt.

16. The cleaner according to claim 14, wherein the fiber bound body is made of a bundle of fibers having a water-absorbing property.

17. The cleaner according to claim 10, wherein the fringe belt is convexly curved in a direction from inside to outside to produce a symmetrical appearance.

* * * * *